US008530770B2

(12) United States Patent
Miwa et al.

(10) Patent No.: US 8,530,770 B2
(45) Date of Patent: Sep. 10, 2013

(54) SWITCH APPARATUS

(75) Inventors: Toshitaka Miwa, Miyagi-Ken (JP); Takashi Fujiki, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 281 days.

(21) Appl. No.: 13/024,857

(22) Filed: Feb. 10, 2011

(65) Prior Publication Data

US 2011/0203910 A1 Aug. 25, 2011

(30) Foreign Application Priority Data

Feb. 23, 2010 (JP) ..... 2010-037591

(51) Int. Cl.
*H01H 15/10* (2006.01)

(52) U.S. Cl.
USPC ..... 200/561; 200/16 C

(58) Field of Classification Search
USPC ..... 200/561–563, 243, 244, 252, 339, 200/16 R, 16 A, 547–550, 16 C, 16 D
See application file for complete search history.

(56) References Cited

U.S. PATENT DOCUMENTS 5,378,863 A * 1/1995 Sekita ..... 200/16 R
5,783,785 A * 7/1998 Furukawa ..... 200/1 B
7,851,714 B2 * 12/2010 Kakuno ..... 200/16 A
2008/0017490 A1 1/2008 Kakuno

FOREIGN PATENT DOCUMENTS

JP 2008-4322 1/2008

* cited by examiner

*Primary Examiner* — Felix O Figueroa
(74) *Attorney, Agent, or Firm* — Beyer Law Group LLP

(57) ABSTRACT

A switch apparatus includes first, second, third, and fourth movable contacts held by a slider and sliding on a circuit board in conjunction with the rotational operation of an operation knob, and a belt-like common fixed contact, an auto fixed contact, a down fixed contact, and an up fixed contact provided on the circuit board. The auto fixed contact, down fixed contact, and up fixed contact are distributed on a straight line parallel to the common fixed contact. The third and fourth movable contacts are normally in sliding contact with the common fixed contact.

4 Claims, 7 Drawing Sheets

SW INPUT CORRESPONDENCE TABLE

| STATE | PORT INPUT | | |
|---|---|---|---|
| | UP | DOWN | AUTO |
| NEUTRAL | High | High | High |
| MANUAL UP | Low | High | High |
| AUTO UP | Low | High | Low |
| MANUAL DOWN | High | Low | High |
| AUTO DOWN | High | Low | Low |

HERE High = 5 V, Low = 0 V

PRIOR ART

SWITCH APPARATUS

CLAIM OF PRIORITY

This application claims benefit of Japanese Patent Application No. 2010-037591 filed on Feb. 23, 2010, which is hereby incorporated by reference.

BACKGROUND OF THE INVENTION

1. Field of the Invention

The present invention relates to a switch apparatus for causing an automotive power window to open and close, and more specifically, it relates to a contact structure of a switch apparatus with which a manual down/up operation and an auto down/up operation of a power window can be selectively performed.

2. Description of the Related Art

This type of power window opening and closing switch apparatus is often disposed, for example, on the inner side of the driver side door of an automobile, and is provided with an operation knob that is rockably supported and on which a push operation and a pull operation can be selectively performed, and a detecting means that detects whether or not a predetermined push operation or pull operation is performed on the operation knob. In a typical example of such a detecting means, movable contacts that slide in conjunction with the rocking of the operation knob is brought into and out of contact with fixed contacts on a circuit board.

FIG. 14 is an explanatory view showing a contact structure in a known power window opening and closing switch apparatus (see, for example, Japanese Unexamined Patent Application Publication No. 2008-4322). In the figure, a common fixed contact 31, a manual down fixed contact 32, a manual up fixed contact 33, an auto down fixed contact 34, and an auto up fixed contact 35 are disposed on a circuit board 30, and first to fourth movable contacts 36*a* to 36*d* are provided on a slider segment (slider) 36 formed of a conductive metal plate. A driving portion is provided in an operation knob (not shown). When this operation knob is rocked (pushed or pulled), the slider segment 36 driven by the driving portion slides along the circuit board 30. Therefore, the movable contacts 36*a* to 36*d* can be brought into and out of contact with the common fixed contact 31 and any one of the other fixed contacts. However, in a neutral state (unoperated state) where the operation knob is not operated, the slider segment 36 is disposed at a neutral position shown in FIG. 14, and therefore the movable contacts 36*a* to 36*d* are all out of contact with the fixed contacts 31 to 35. According to the slide position of the slider segment 36, the first movable contact 36*a* can be brought into and out of contact with the fixed contacts 31 and 32, the second movable contact 36*b* can be brought into and out of contact with the fixed contacts 31 and 33, the third movable contact 36*c* can be brought into and out of contact with the fixed contacts 31 and 34, and the fourth movable contact 36*d* can be brought into and out of contact with the fixed contacts 31 and 35.

That is to say, when the slider segment 36 is at the neutral position shown in FIG. 14, the common fixed contact 31 is not electrically connected with any of the fixed contacts 32 to 35, and therefore a command signal that rotationally drives a power window drive motor is not output. However, with the pushing of the operation knob, the slider segment 36 slides downward in FIG. 14. Therefore, by rotating the operation knob to a halfway pushed position, the switch apparatus can be brought into a state where the first movable contact 36*a* is in contact with the manual down fixed contact 32, the fourth movable contact 36*d* is in contact with the common fixed contact 31, and the second movable contact 36*b* and the third movable contact 36*c* are out of contact with the fixed contacts 31 and 34, respectively. Thus, the manual down fixed contact 32 and the common fixed contact 31 are electrically connected with each other through the slider segment 36, and therefore a command signal is output that causes the power window to perform opening operation, and the motor is driven in the forward direction. When the operation force is removed in this state, the operation knob is automatically returned to the neutral position shown in FIG. 14 by the elastic force of a return spring (not shown), and therefore the opening operation of the power window stops. By rotating the operation knob to a fully pushed position, the switch apparatus can be brought into a state where the third movable contact 36*c* is in contact with the auto down fixed contact 34 and the second movable contact 36*b* is in contact with the common fixed contact 31. Thus, the auto down fixed contact 34 and the common fixed contact 31 are electrically connected with each other through the slider segment 36, and therefore a command signal is output that causes the power window to open fully, and the motor is driven in the reverse direction until the power window opens fully.

On the other hand, with the pulling of the operation knob, the slider segment 36 slides upward in FIG. 14. Therefore, by rotating the operation knob to a halfway pulled position, the switch apparatus can be brought into a state where the second movable contact 36*b* is in contact with the manual up fixed contact 33, the third movable contact 36*c* is in contact with the common fixed contact 31, and the first movable contact 36*a* and the fourth movable contact 36*d* are out of contact with the fixed contacts 31 and 35, respectively. Thus, the manual up fixed contact 33 and the common fixed contact 31 are electrically connected with each other through the slider segment 36, and therefore a command signal is output that causes the power window to perform closing operation, and the motor is driven in the reverse direction. When the operation force is removed in this state, the operation knob is automatically returned to the neutral position shown in FIG. 14, and therefore the closing operation of the power window stops. By rotating the operation knob to a fully pulled position, the switch apparatus can be brought into a state where the first movable contact 36*a* is in contact with the common fixed contact 31 and the fourth movable contact 36*d* is in contact with the auto up fixed contact 35. Thus, the auto up fixed contact 35 and the common fixed contact 31 are electrically connected with each other through the slider segment 36, and therefore a command signal is output that causes the power window to close fully, and the motor is driven in the reverse direction until the power window closes fully.

In the known power window opening and closing switch apparatus having such a contact structure, the common fixed contact 31 is substantially equidistant from the four fixed contacts 32 to 35. Therefore, four types of signals (a manual down command signal, an auto down command signal, a manual up command signal, and an auto up command signal) according to the pushing and pulling of the operation knob can be reliably derived. In addition, because all of the fixed contacts 31 to 35 can be disposed in an elongate region on the circuit board 30, the switch apparatus 1 has a good space factor and can be easily reduced in size.

However, in the case of a power window opening and closing switch apparatus in which five fixed contacts 31 to 35 are distributed on a circuit board 30 as in the above-described known switch apparatus, wiring patterns for the five fixed contacts 31 to 35 need to be formed on the circuit board 30. For this reason, the wiring layout on the circuit board 30 tends to be complex and dense. This limits the degree of freedom of circuit design and increases the manufacturing cost.

SUMMARY OF THE INVENTION

The present invention provides a power window opening and closing switch apparatus that has a small number of fixed contacts and is easy to design and manufacture.

In an aspect of the present invention, a switch apparatus includes an operation knob supported rockably and capable of being pushed and pulled, a circuit board having a plurality of fixed contacts disposed thereon, a slider moving linearly in conjunction with the rocking of the operation knob, and a plurality of movable contacts held by the slider. The switch apparatus can output signals causing an automotive power window to open and close, by bringing the movable contacts into and out of contact with the fixed contacts with the movement of the slider. The plurality of fixed contacts include an auto fixed contact, a down fixed contact located at a distance from the auto fixed contact on one side of the direction of movement of the slider, an up fixed contact located at a distance from the auto fixed contact on the other side of the direction of movement of the slider, and a common fixed contact located at least at the side of the auto fixed contact and at a distance therefrom and extending in the direction of movement of the slider. The plurality of movable contacts include a first movable contact capable of being brought into and out of contact with the auto fixed contact and the down fixed contact, a second movable contact capable of being brought into and out of contact with the auto fixed contact and the up fixed contact, and normally-closed movable contacts normally in sliding contact with the common fixed contact.

From a power window opening and closing switch apparatus having such a contact structure, four types of signals (a manual down command signal, an auto down command signal, a manual up command signal, and an auto up command signal) according to the pushing and pulling of the operation knob can be reliably derived, by bringing the movable contacts held by the slider into and out of contact with the four fixed contacts that can be compactly disposed on the circuit board. Therefore, the switch apparatus has a good space factor and can be easily reduced in size. In addition, because the number of fixed contacts is four and only four wiring patterns are required, the wiring layout on the circuit board can be simplified. Therefore, the degree of freedom of circuit design can be improved, and the manufacturing cost can be reduced.

It is preferable that when the operation knob is not operated, the distance between the first movable contact and the down fixed contact be set smaller than the distance between the second movable contact and the auto fixed contact, and the distance between the second movable contact and the up fixed contact be set smaller than the distance between the first movable contact and the auto fixed contact; when the operation knob is pushed, a manual down command signal be output by bringing the first movable contact into contact with the down fixed contact with the second movable contact out of contact with the auto fixed contact, and an auto down command signal be output by bringing the second movable contact into contact with the auto fixed contact with the first movable contact in contact with the down fixed contact; and when the operation knob is pulled, a manual up command signal be output by bringing the second movable contact into contact with the up fixed contact with the first movable contact out of contact with the auto fixed contact, and an auto up command signal be output by bringing the first movable contact into contact with the auto fixed contact with the second movable contact in contact with the up fixed contact.

It is preferable that the auto fixed contact be provided at a position equidistant from the down fixed contact and the up fixed contact, and the first movable contact and the second movable contact be disposed at positions equidistant from the auto fixed contact when the operation knob is not operated. In this case, the contact structure can be extremely simplified, and therefore the timing to derive the first to fourth signals can be easily set with a high degree of accuracy.

It is preferable that the common fixed contact extend from the side of the down fixed contact to the side of the up fixed contact, the normally-closed movable contacts include a third movable contact and a fourth movable contact, and the third and fourth movable contacts and the first and second movable contacts be distributed substantially at the four corners of a rectangle. In this case, the slider can be easily slid in a stable position relative to the circuit board.

DESCRIPTION OF THE PREFERRED EMBODIMENTS

Figure 1:
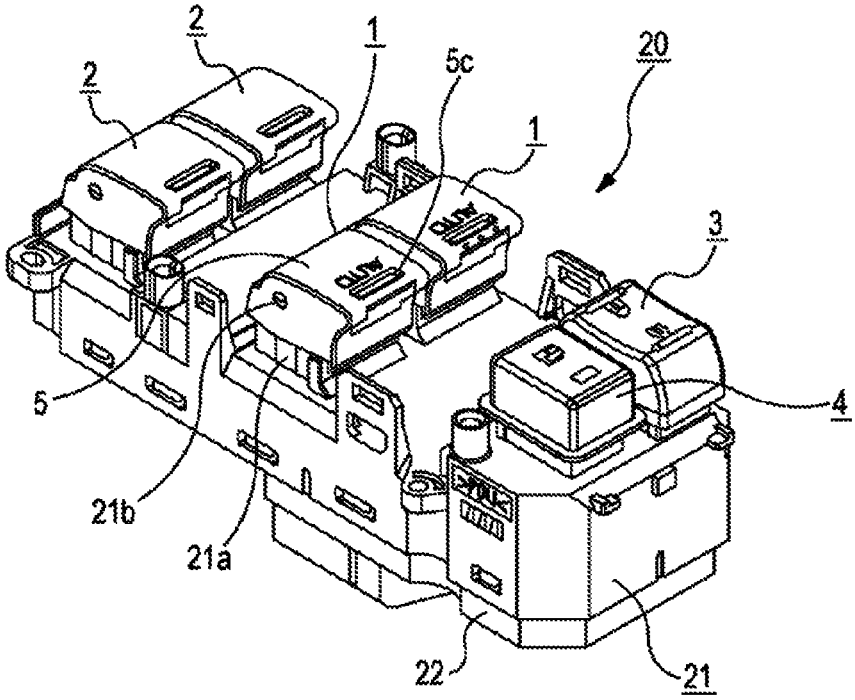
FIG. 1 is an external view of a switch unit including a switch apparatus according to an embodiment of the present invention.

A switch apparatus 1 according to an embodiment of the present invention will be described. As shown in FIG. 1, this switch apparatus 1 is incorporated in a switch unit 20. The switch unit 20 is placed on the inner side of the driver side door of an automobile and includes two types of switch apparatuses 1 and 2 for opening and closing a power window, a switch apparatus 3 for locking and unlocking the door, and a switch apparatus 4 for locking and unlocking the power window. The outer shell of the switch unit 20 includes a case 21 on the upper side of which operation knobs of the switch apparatuses 1 to 4 are disposed, and a cover body 22 that covers a lower opening of the case 21. A circuit board 23 placed on the cover body 22 is housed in the case 21 (see FIGS. 2 to 6).

Of the two types of switch apparatuses 1 and 2 for opening and closing the power window, the switch apparatuses 1 according to this embodiment can output manual command signals and auto command signals, whereas the switch apparatuses 2, to which the present invention is not applicable, can output only manual command signals. The present invention is not applicable to the other switch apparatuses 3 and 4 not for opening and closing the power window, either. So, the description of the switch apparatuses 2 to 4 will be omitted.

A switch apparatus 1 according to this embodiment will be described with reference to FIGS. 1 to 13. This switch apparatus 1 mainly includes an operation knob 5 rockably supported by a pair of vertical walls 21*a* of the case 21, four fixed contacts 6 to 9 disposed on the circuit board 23, a slider 10 that slides linearly in the longitudinal direction of the circuit board 23 in conjunction with the rocking of the operation knob 5, a slider segment 11 that is held on the bottom surface of the slider 10 and slides on the circuit board 23, a coil spring 12 incorporated in the operation knob 5 as a return spring, and a light guide 13 incorporated between the pair of vertical walls of the case 21 in order to illuminate the operation knob 5. In each of FIGS. 2 to 6, the upper part shows the positional relationship between the operation knob 5 and the slider 10, and the lower part shows the positional relationship between the circuit board 23 and the slider 10.

Figure 2:
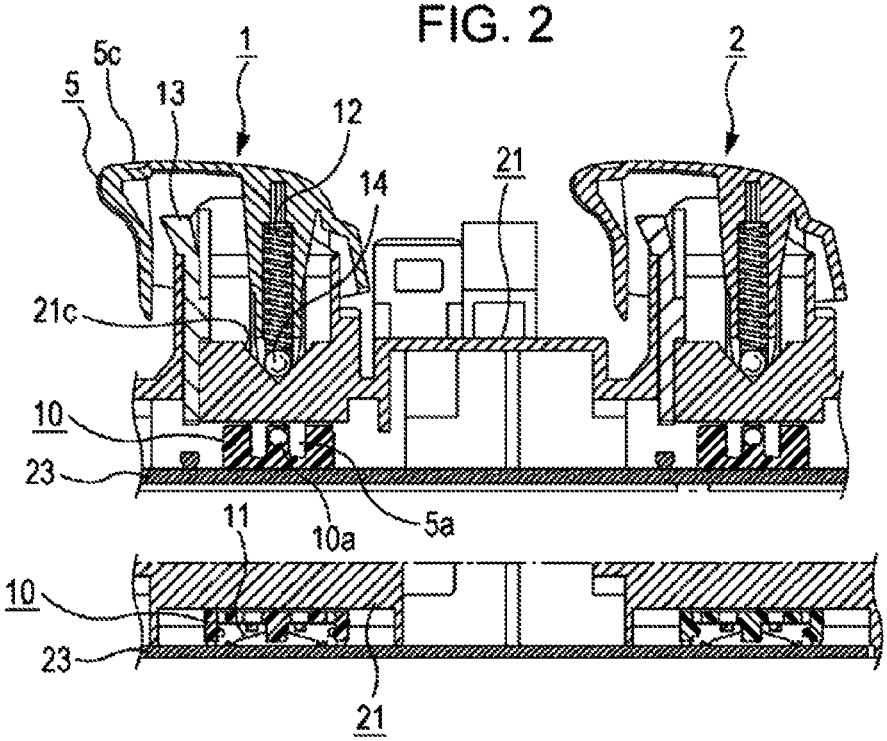
FIG. 2 is an explanatory view showing a neutral state of the switch apparatus.

A supporting shaft 21*b* projects from each of the vertical walls of the case 21 and rockably supports the operation knob 5. The case 21 has a V-shaped groove-like cam surface 21*c* formed between the pair of vertical walls 21*a*. As shown in FIG. 2, the cam surface 21*c* is normally in elastic contact with a steel ball 14 urged by the coil spring 12.

Figure 7:
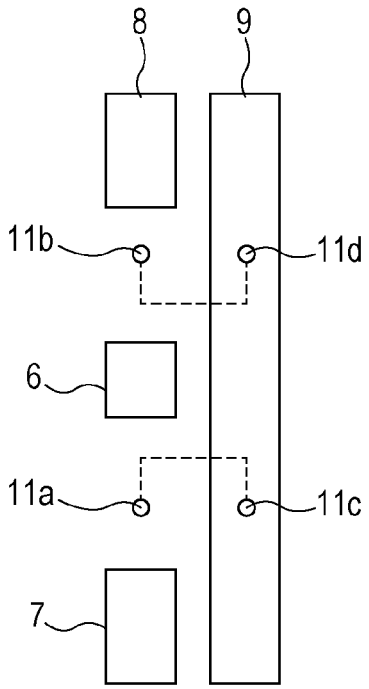
FIG. 7 is an explanatory view showing the positions of movable contacts of the switch apparatus in the neutral state.
Figure 8:
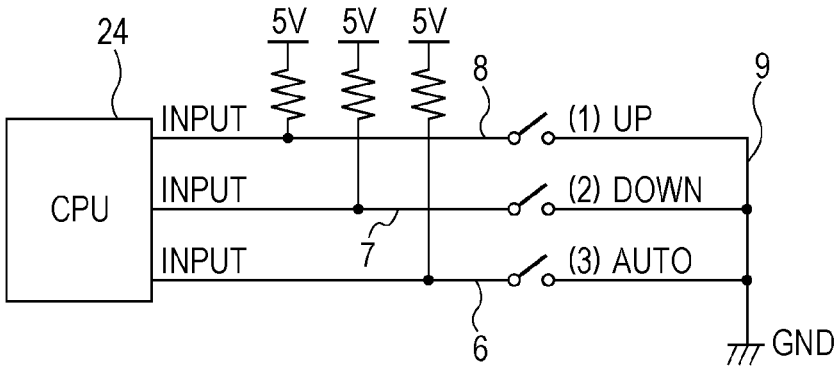
FIG. 8 is an equivalent circuit schematic corresponding to FIG. 7.

As shown in FIG. 7, on the circuit board 23 are formed an auto fixed contact 6, a down fixed contact 7, an up fixed contact 8, and a common fixed contact 9 as fixed contacts for the switch apparatus 1. The auto fixed contact 6 is located midway between the down fixed contact 7 and the up fixed contact 8. The three fixed contacts 6 to 8 are lined up along the longitudinal direction of the circuit board 23 (the sliding direction of the slider 10). That is to say, the down fixed contact 7 is located at a distance from the auto fixed contact 6 on one side of the sliding direction of the slider 10, the up fixed contact 8 is located at a distance from the auto fixed contact 6 on the other side of the sliding direction of the slider 10, and the distance between the fixed contacts 6 and 7 is equal to the distance between the fixed contacts 6 and 8. At the side of the three fixed contacts 6 to 8 is provided a belt-like common fixed contact 9 extending along the sliding direction of the slider 10. The distances between the common fixed contact 9 and the fixed contacts 6 to 8 are equal. As shown in FIG. 8, the common fixed contact 9 is a grounded conductor portion, and a predetermined voltage (for example, 5 V) is applied to each of the other three fixed contacts 6 to 8.

The operation knob 5 is rotatable around the supporting shaft 21*b* of the case 21. A two-step push operation and a two-step pull operation can be selectively performed. The operation knob 5 has a U-shaped driving portion 5*a* that projects downward and slidably engages with the shaft portion 10*a* of the slider 10, and a cylindrical recessed portion 5*b* that houses the coil spring 12. In the upper wall portion of the operation knob 5 is provided an illuminated portion 5*c* that can be illuminated by the light guide 13. When the operation knob 5 is rotated (pushed or pulled), the steel ball 14 compresses the coil spring 12 in the cylindrical recessed portion 5*b* while moving upward along the cam surface 21*c*. When the operation force is removed, the steel ball 14 is pushed back by the elastic force of the coil spring 12 to the valley portion of the cam surface 21*c*, and the operation knob 5 is automatically returned to the neutral position shown in FIG. 2.

The slider 10 has a shaft portion 10*a* projecting from the side surface thereof, and the shaft portion 10*a* is slidably engaged with the driving portion 5*a* of the operation knob 5. Therefore, as shown in FIGS. 3 to 6, when the operation knob 5 is rotated, the shaft portion 10*a* is driven by the driving portion 5*a* and slides in the left-right direction in the figure. Therefore, in conjunction with the rocking of the operation knob 5, the slider 10 slides linearly along the circuit board 23.

The slider segment 11 is formed of a single conductive metal plate. At the four corners of the slider segment 11, first to fourth movable contacts 11*a* to 11*d* are provided. The slider segment 11 slides integrally with the slider 10 with the movable contacts 11*a* to 11*d* in sliding contact with the circuit board 23. At that time, the first and second movable contacts 11*a* and 11*b* slide on a straight line connecting the three fixed contacts 6 to 8, and the third and fourth movable contacts 11*c* and 11*d* slide on the belt-like common fixed contact 9. That is to say, the third and fourth movable contacts 11*c* and 11*d* are normally in sliding contact with the common fixed contact 9 and grounded, and therefore the third and fourth movable contacts 11*c* and 11*d* will hereinafter be collectively referred to as normally-closed movable contact. The first movable contact 11*a* can be brought into and out of contact with the auto fixed contact 6 and the down fixed contact 7, and the second movable contact 11*b* can be brought into and out of contact with the auto fixed contact 6 and the up fixed contact 8. In the case of this embodiment, the first and third movable contacts 11*a* and 11*c* are not electrically connected with the second and fourth movable contacts 11*b* and 11*d*. However, if the first and third movable contacts 11*a* and 11*c* are electrically connected with the second and fourth movable contacts 11*b* and 11*d*, the same function can be achieved.

The positional relationship between the first and second movable contacts 11*a* and 11*b* and the fixed contacts 6 to 8 will be described. In a neutral state where the operation knob 5 is not operated, the first movable contact 11*a* is located between the fixed contacts 6 and 7 and the second movable contact 11*b* is located between the fixed contacts 6 and 8 as shown in FIG. 7. That is to say, the movable contacts 11*a* and 11*b* are out of contact with any of the fixed contacts 6 to 8. The movable contacts 11*a* and 11*b* are disposed symmetrically with respect to the auto fixed contact 6. At this time, the distance between the first movable contact 11*a* and the down fixed contact 7 is smaller than the distance between the second movable contact 11*b* and the auto fixed contact 6. Similarly, the distance between the second movable contact 11*b* and the up fixed contact 8 is smaller than the distance between the first movable contact 11*a* and the auto fixed contact 6.

Figure 9:
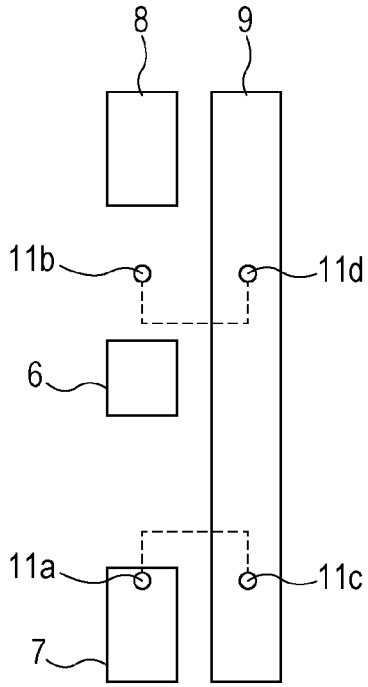
FIG. 9 is an explanatory view showing the positions of movable contacts of the switch apparatus in the manual down command state.

However, when the operation knob 5 is rotated (pushed or pulled), the slider segment 11 slides integrally with the slider 10, and therefore four types of signals can be derived by bringing the first movable contact 11*a* and the second movable contact 11*b* into contact with the fixed contacts 6 to 8. When the operation knob 5 is pushed, the slider segment 11 slides to the down fixed contact 7 side. When the operation knob 5 is pulled, the slider segment 11 slides to the up fixed contact 8 side. Therefore, for example, by rotating the operation knob 5 to the halfway pushed position shown in FIG. 3, the first movable contact 11*a* can be brought into contact with the down fixed contact 7 with the second movable contact 11*b* out of contact with the auto fixed contact 6 as shown in FIG. 9. Thus, the down fixed contact 7 is electrically connected through the slider segment 11 with the common fixed contact 9, and therefore a first signal (manual down command signal) can be derived. Similarly, by rotating the operation knob 5 to the halfway pulled position shown in FIG. 5, the second movable contact 11*b* can be brought into contact with the up fixed contact 8 with the first movable contact 11*a* out of contact with the auto fixed contact 6. Thus, the up fixed contact 8 is electrically connected through the slider segment 11 with the common fixed contact 9, and therefore a second signal (manual up command signal) can be derived.

Figure 4:
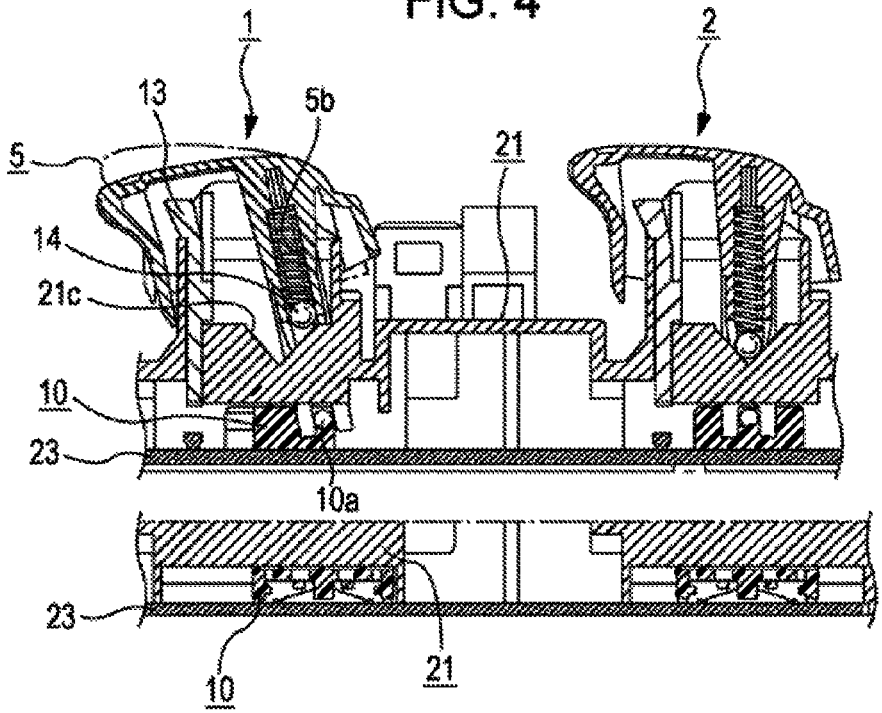
FIG. 4 is an explanatory view showing an auto down command state of the switch apparatus.
Figure 11:
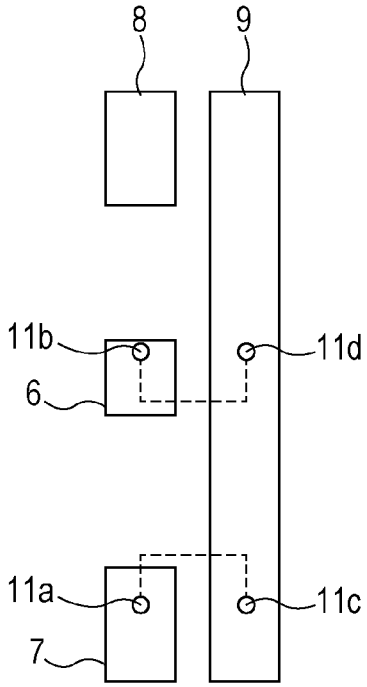
FIG. 11 is an explanatory view showing the positions of movable contacts of the switch apparatus in the auto down command state.

By rotating the operation knob 5 to the fully pushed position shown in FIG. 4, the second movable contact 11*b* can be brought into contact with the auto fixed contact 6 with the first movable contact 11*a* in contact with the down fixed contact 7 as shown in FIG. 11. Thus, both the auto fixed contact 6 and the down fixed contact 7 are electrically connected through the slider segment 11 with the common fixed contact 9, and therefore a third signal (auto down command signal) can be derived. Similarly, by rotating the operation knob 5 to the fully pulled position shown in FIG. 6, the first movable contact 11*a* can be brought into contact with the auto fixed contact 6 with the second movable contact 11*b* in contact with the up fixed contact 8. Thus, both the auto fixed contact 6 and the up fixed contact 8 are electrically connected through the slider segment 11 with the common fixed contact 9, and therefore a fourth signal (auto up command signal) can be derived.

Next, the operation of the switch apparatus 1 configured as above will be described. When the operation knob 5 is in a neutral state where the operation knob 5 is not operated, the slider 10 and the slider segment 11 are disposed at their neutral positions shown in FIG. 2. At this time, the first and second movable contacts 11*a* and 11*b* are out of contact with any of the fixed contacts 6 to 8, and therefore, as shown in FIG. 7, the common fixed contact 9 is not electrically connected with the fixed contacts 6 to 8. Therefore, the equivalent circuit of the switch apparatus 1 is as shown in FIG. 8, and the voltage levels of the signals input from the fixed contacts 6 to 8 into a CPU (Central Processing Unit) 24 are all High (5 V). This state is such a state where the switch apparatus 1 does not output a command signal that rotationally drives the power window drive motor.

Figure 3:
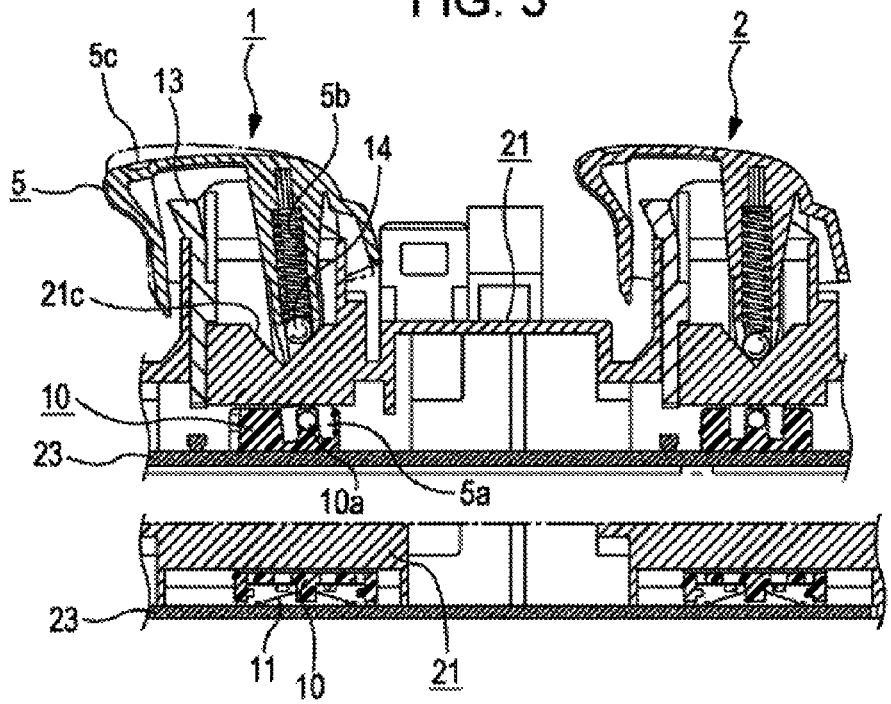
FIG. 3 is an explanatory view showing a manual down command state of the switch apparatus.
Figure 10:
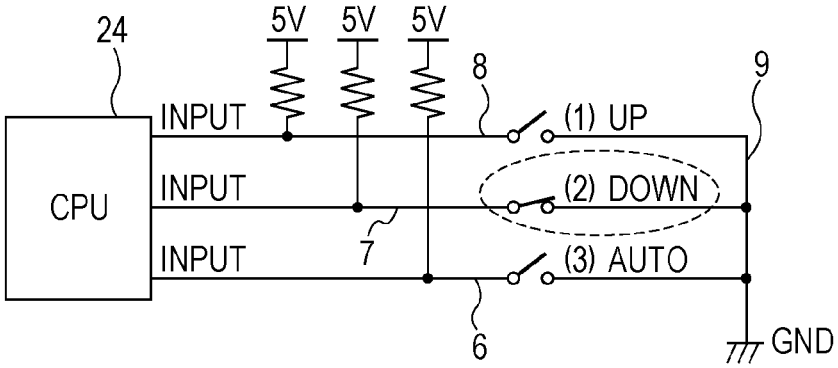
FIG. 10 is an equivalent circuit schematic corresponding to FIG. 9.

However, when the operation knob 5 is pushed halfway and thereby rotated to the halfway pushed position as shown in FIG. 3, the slider segment 11 slides a predetermined distance to the down fixed contact 7 side, and the switch apparatus 1 is brought into a state where, as shown in FIG. 9, the first movable contact 11*a* is in contact with the down fixed contact 7 and the second movable contact 11*b* does not reach the auto fixed contact 6. Thus, the down fixed contact 7 is electrically connected through the slider segment 11 with the common fixed contact 9, and therefore the equivalent circuit of the switch apparatus 1 is as shown in FIG. 10, and the voltage level of the signal input from the down fixed contact 7 into the CPU 24 switches to Low (0 V). However, the voltage levels of the signals input from the fixed contacts 6 and 8 into the CPU 24 remain High (5 V). This state is such a state where the switch apparatus 1 outputs a first signal (manual down command signal). The first signal drives the motor in the forward direction and thereby the power window performs opening operation. When the operation force is removed in this state, the steel ball 14 is pushed back to the valley portion of the cam surface 21*c* and thereby the operation knob 5 is automatically returned to the neutral position shown in FIG. 2 as described above. Therefore, the opening operation of the power window stops.

Figure 12:
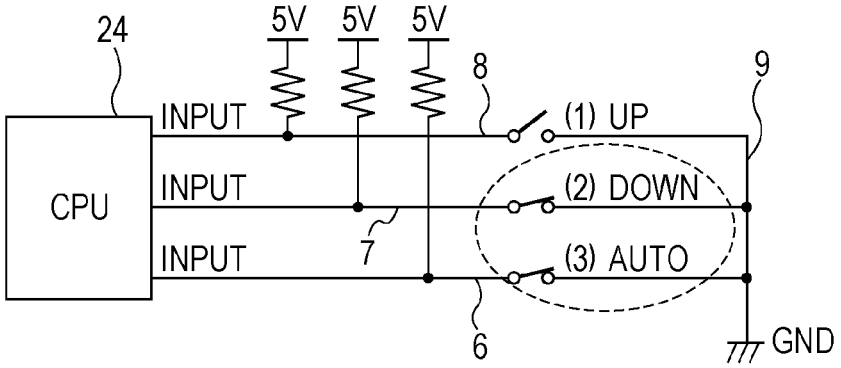
FIG. 12 is an equivalent circuit schematic corresponding to FIG. 11.

When the operation knob 5 is pushed fully and thereby rotated to the fully pushed position as shown in FIG. 4, the slider segment 11 slides further to the down fixed contact 7 side, and the switch apparatus 1 is brought into a state where, as shown in FIG. 11, the first movable contact 11*a* is in contact with the down fixed contact 7 and the second movable contact 11*b* is in contact with the auto fixed contact 6. Thus, the down fixed contact 7 and the auto fixed contact 6 are electrically connected through the slider segment 11 with the common fixed contact 9, and therefore the equivalent circuit of the switch apparatus 1 is as shown in FIG. 12, and the voltage levels of the signals input from the down fixed contact 7 and the auto fixed contact 6 into the CPU 24 switch to Low (0 V). This state is such a state where the switch apparatus 1 outputs a third signal (auto down command signal). The third signal drives the motor in the forward direction until the power window opens fully. That is to say, once the third signal is output from the switch apparatus 1, the power window continues opening operation until the power window opens fully, even if the operation force is removed and the operation knob 5 is automatically returned to the neutral position.

Figure 5:
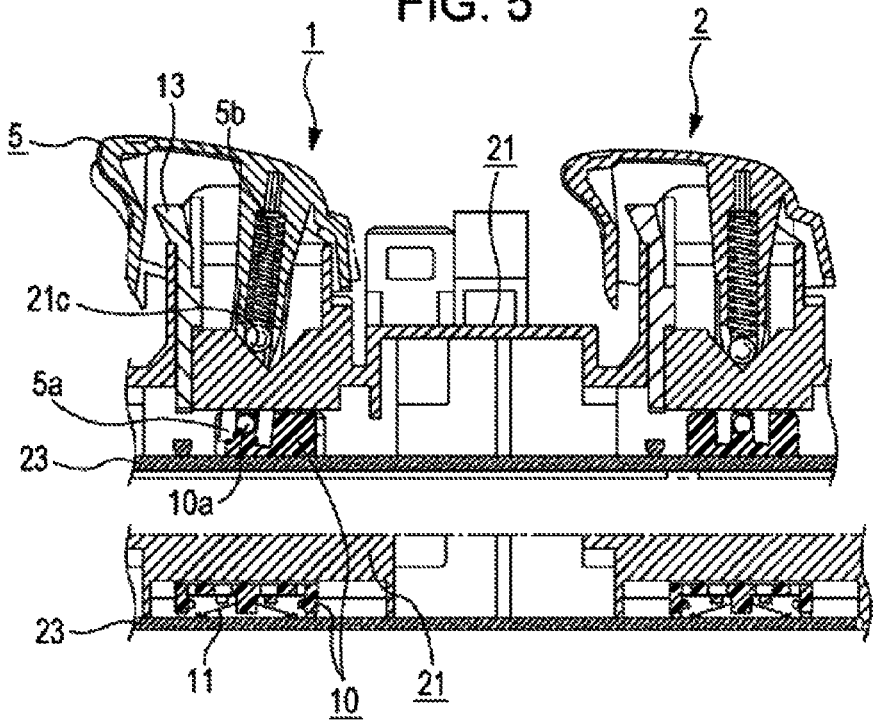
FIG. 5 is an explanatory view showing a manual up command state of the switch apparatus.

The operation at the time of the pull operation is basically the same as the operation at the time of the push operation. That is to say, when the operation knob 5 is pulled halfway and thereby rotated to the halfway pulled position as shown in FIG. 5, the slider segment 11 slides a predetermined distance to the up fixed contact 8 side, and the switch apparatus 1 is brought into a state where the second movable contact 11*b* is in contact with the up fixed contact 8 and the first movable contact 11*a* does not reach the auto fixed contact 6. Thus, the up fixed contact 8 is electrically connected through the slider segment 11 with the common fixed contact 9, and therefore the voltage level of the signal input from the up fixed contact 8 into the CPU 24 switches to Low. This state is such a state where the switch apparatus 1 outputs a second signal (manual up command signal). The second signal drives the motor in the reverse direction, and therefore the power window performs closing operation. In this case, when the operation force is removed, the operation knob 5 is automatically returned to the neutral position, and therefore the closing operation of the power window stops.

Figure 6:
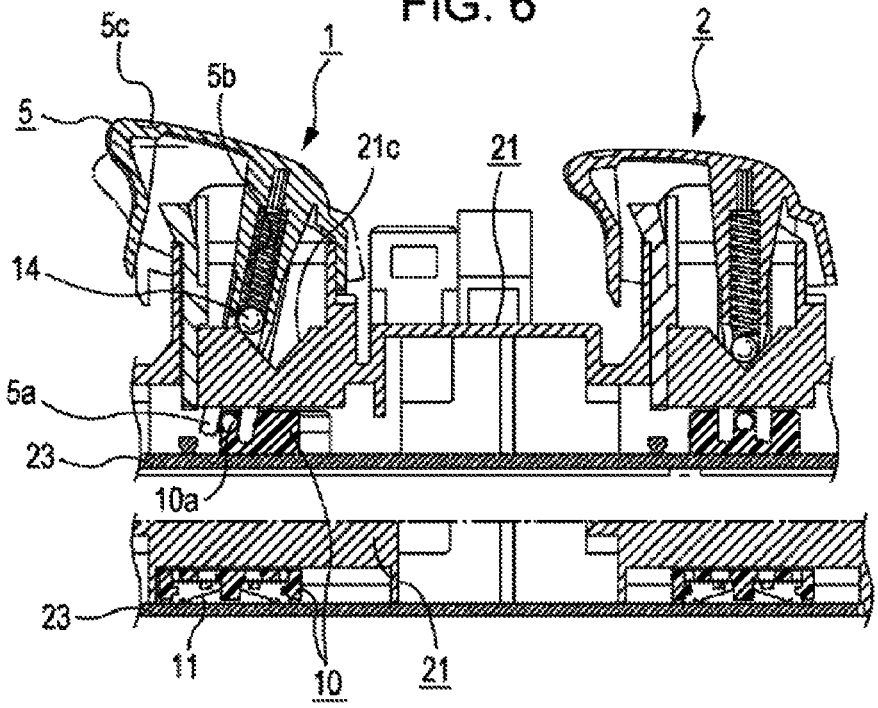
FIG. 6 is an explanatory view showing an auto up command state of the switch apparatus.

When the operation knob 5 is pulled fully and thereby rotated to the fully pulled position as shown in FIG. 6, the slider segment 11 slides further to the up fixed contact 8 side, and the switch apparatus 1 is brought into a state where the second movable contact 11*b* is in contact with the up fixed contact 8 and the first movable contact 11*a* is in contact the auto fixed contact 6. Thus, the up fixed contact 8 and the auto fixed contact 6 are electrically connected through the slider segment 11 with the common fixed contact 9, and therefore the voltage levels of the signals input from the up fixed contact 8 and the auto fixed contact 6 into the CPU 24 switch to Low. This state is such a state where the switch apparatus 1 outputs a fourth signal (auto up command signal). The fourth signal drives the motor in the reverse direction until the power window closes fully. That is to say, once the fourth signal is output from the switch apparatus 1, the power window continues closing operation until the power window closes fully, even if the operation force is removed and the operation knob 5 is automatically returned to the neutral position.

Figures 13, 14:
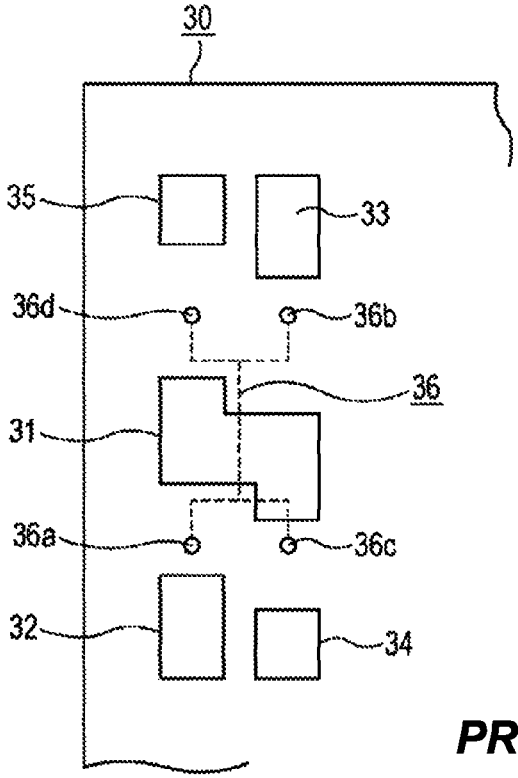
FIG. 13 shows the voltage levels of signals input from fixed contacts of the switch apparatus into a CPU in each operation state.
FIG. 14 is an explanatory view showing the positions of movable contacts of a known switch apparatus in a neutral state.

The voltage levels of signals input from the fixed contacts 6 to 8 of the switch apparatus 1 into the CPU 24 in each operation state are tabulated in FIG. 13. The switch apparatus 1 is configured so that when the operation knob 5 is rotated to a predetermined pushed or pulled position, the steel ball 14 crosses the edge of the cam surface 21*c* and thereby a clicking sensation is produced.

As described above, from the power window opening and closing switch apparatus 1 according to this embodiment, four types of signals (a manual down command signal, an auto down command signal, a manual up command signal, and an auto up command signal) according to the pushing and pulling of the operation knob 5 can be reliably derived, by bringing the movable contacts (first movable contact 11*a*, second movable contact 11*b*, and normally-closed movable contacts 11*c* and 11*d*) of the slider segment 11 held by the slider 10 into contact with the four fixed contacts (auto fixed contact 6, down fixed contact 7, up fixed contact 8, and common fixed contact 9) that can be compactly disposed on the circuit board 23. Therefore, the switch apparatus 1 has a good space factor and can be easily reduced in size. In addition, because the number of fixed contacts is four and only four wiring patterns are required, the wiring layout on the circuit board 23 can be simplified.

In the switch apparatus 1, the auto fixed contact 6 is provided at a position equidistant from the down fixed contact 7 and the up fixed contact 8, and the first movable contact 11*a* and the second movable contact 11*b* are disposed at positions equidistant from the auto fixed contact 6 when the operation knob 5 is not operated. Therefore, the contact structure is extremely simple, and the timing to derive the first to fourth signals can be easily set with a high degree of accuracy.

By changing the shape of the slider segment 11, the common fixed contact 9 can be made shorter than in the above embodiment. However, when the common fixed contact 9 extends from the side of the down fixed contact 7 to the side of the up fixed contact 8, and when the first and second movable contacts 11*a* and 11*b* and the third and fourth movable contacts 11*c* and 11*d* that are normally-closed movable contacts are distributed substantially at the four corners of a rectangle, the slider 10 can be easily slid in a stable position relative to the circuit board 23.

What is claimed is:

1. A switch apparatus comprising:

an operation knob supported rockably and capable of being pushed and pulled;

a circuit board having a plurality of fixed contacts arranged thereon in a first direction and a second direction perpendicular to the first direction;

a slider capable of moving linearly in the first direction in conjunction with the rocking of the operation knob; and a plurality of movable contacts held by the slider, wherein the switch apparatus is configured to output signals causing an automotive power window to open and close, by bringing the movable contacts into and out of contact with the fixed contacts with a movement of the slider in the first direction, wherein the plurality of fixed contacts include:

an auto fixed contact;

a down fixed contact located on one side of the auto fixed contact at a certain distance therefrom in the first direction;

an up fixed contact located on another side of the auto fixed contact at a certain distance therefrom in the first direction; and a common fixed contact extending in the first direction and located on one side of the auto fixed contact at a certain distance therefrom in the second direction, and wherein the plurality of movable contacts include:

a first movable contact capable of being brought into and out of contact with the auto fixed contact and the down fixed contact;

a second movable contact capable of being brought into and out of contact with the auto fixed contact and the up fixed contact; and normally-closed movable contacts normally in sliding contact with the common fixed contact.

2. The switch apparatus according to claim 1, wherein:

when the operation knob is not operated, a first distance between the first movable contact and the down fixed contact is set smaller than a second distance between the second movable contact and the auto fixed contact, and a third distance between the second movable contact and the up fixed contact is set smaller than a forth distance between the first movable contact and the auto fixed contact;

when the operation knob is pushed, a manual down command signal is output by bringing the first movable contact into contact with the down fixed contact while the second movable contact is out of contact with the auto fixed contact, and an auto down command signal is output by bringing the second movable contact into contact with the auto fixed contact while the first movable contact is in contact with the down fixed contact; and when the operation knob is pulled, a manual up command signal is output by bringing the second movable contact into contact with the up fixed contact while the first movable contact is out of contact with the auto fixed contact, and an auto up command signal is output by bringing the first movable contact into contact with the auto fixed contact while the second movable contact is in contact with the up fixed contact.

3. The switch apparatus according to claim 1, wherein the auto fixed contact is provided at a position equidistant from the down fixed contact and the up fixed contact, and the first movable contact and the second movable contact are disposed at positions equidistant from the auto fixed contact when the operation knob is not operated.

4. The switch apparatus according to claim 1, wherein the common fixed contact extends in the first direction from a side of the down fixed contact in the second direction to a side of the up fixed contact in the second direction, wherein the normally-closed movable contacts include a third movable contact and a fourth movable contact, and wherein the third and fourth movable contacts and the first and second movable contacts are arranged to substantially form four corners of a rectangle.

* * * * *